US006796776B2

(12) United States Patent
Jolley et al.

(10) Patent No.: US 6,796,776 B2
(45) Date of Patent: Sep. 28, 2004

(54) PUMPING SYSTEM AND METHOD WITH IMPROVED SCREEN

(75) Inventors: Mark W. Jolley, Carlsbad, CA (US); Paul R. Yandell, Vista, CA (US)

(73) Assignee: Dimension One Spas, Vista, CA (US)

( * ) Notice: Subject to any disclaimer, the term of this patent is extended or adjusted under 35 U.S.C. 154(b) by 69 days.

(21) Appl. No.: 10/279,175

(22) Filed: Oct. 23, 2002

(65) Prior Publication Data

US 2004/0081559 A1 Apr. 29, 2004

(51) Int. Cl.[7] ..... F04B 39/16

(52) U.S. Cl. ..... 417/313; 417/12; 417/87; 210/108

(58) Field of Search ..... 417/313, 12, 87, 417/199.1; 210/108, 411, 416.2, 169

(56) References Cited

U.S. PATENT DOCUMENTS 3,188,974 A * 6/1965 Rosaen ..... 417/313
4,935,151 A * 6/1990 Do ..... 210/739
5,785,846 A * 7/1998 Barnes et al. ..... 210/169
5,863,128 A 1/1999 Mazzei
6,497,814 B1 * 12/2002 Alexander et al. ..... 210/108
6,520,752 B1 * 2/2003 Hosford ..... 417/313
6,543,624 B1 * 4/2003 Geisbauer ..... 210/411

* cited by examiner

*Primary Examiner*—Charles G. Freay
(74) *Attorney, Agent, or Firm*—Fish & Richardson P.C.

(57) ABSTRACT

A system and method for reducing the collection of debris in a fluid pumping system. The system and method may be used in pools, spas, or other applications in which fluids are circulated through a fluid-containing vessel. The system includes a first pump that circulates fluid. A screen is coupled to the input of the first pump and acts to prevent debris from reaching the first pump. A second pump may be used to remove debris from the screen.

29 Claims, 2 Drawing Sheets

FIG. 1
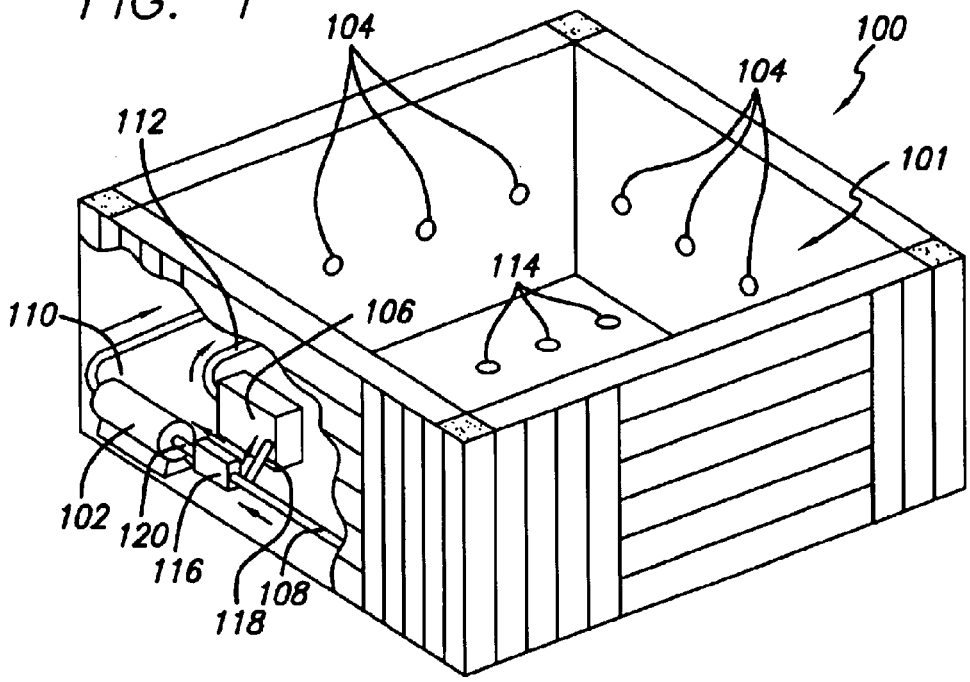
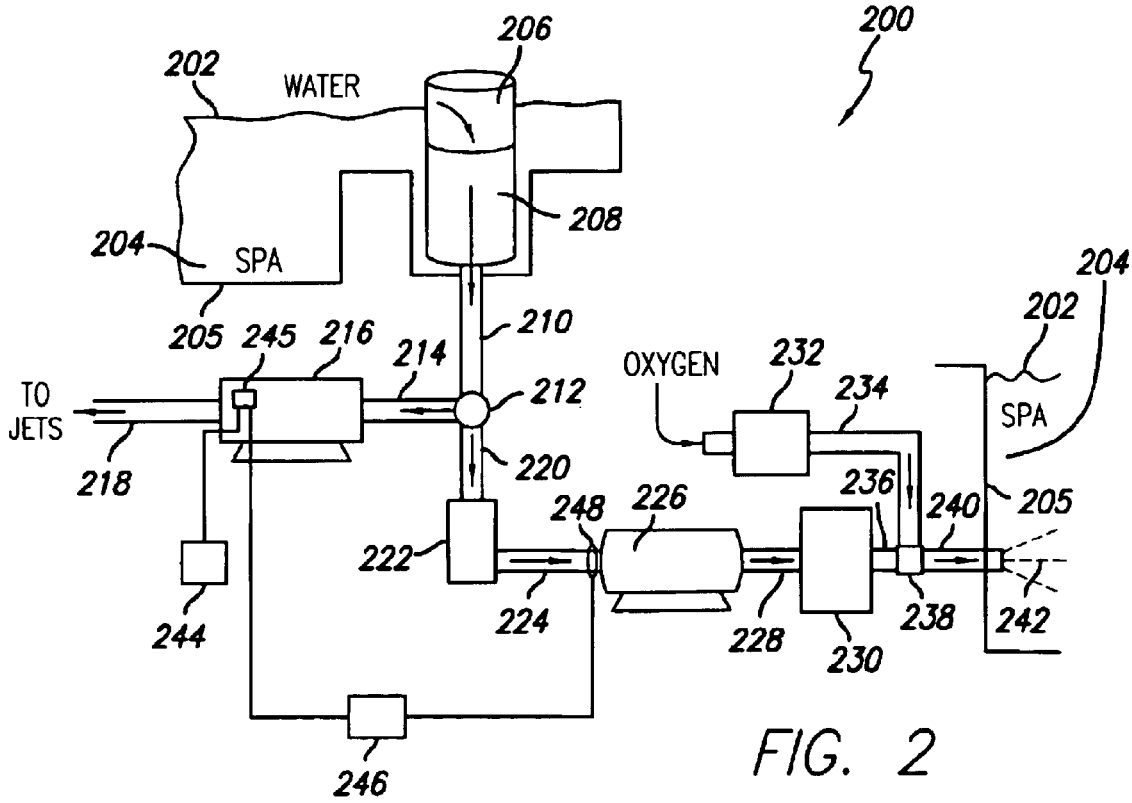
FIG. 2

PUMPING SYSTEM AND METHOD WITH IMPROVED SCREEN

TECHNICAL FIELD

This invention relates to a system and method for pumping fluids, such as water. More particularly, the present invention relates to a self-cleaning screening system and method that reduces the collection of debris in water pumps and other devices in a fluid pumping system.

BACKGROUND

In order to pump fluids, from one location to another, pipes are used as fluid conduits, and pumps are used to force fluid through the pipes. For example, in a pool or spa (or hot tub), a pumping system may be used to draw water into an inlet located in the pool or spa and to force the water out of an outlet back into the pool or spa. (Those skilled in the art will understand that the terms "spa" and "hot tub" are generally used interchangeably. For simplicity, the remainder of this description will use only the term "spa," which will be understood to encompass spas and hot tubs.) Generally, such pumping systems will include one or more skimmers and/or filters located downstream from the inlet and upstream from a pump to prevent debris from reaching the pump, as build-up of debris at a pump's input may render the pump inoperable.

Some debris, however, may not be trapped by the skimmer and filter, thereby allowing such untrapped debris to reach the pump. As a result, some pumping systems have incorporated a screen (or screen-trap) upstream of the pump's input in order to capture untrapped debris. While these screens do reduce and even prevent debris from reaching the pump, they must be manually cleaned and maintained, making them cumbersome and costly.

Accordingly a need exists for a pumping system that includes an effective pump screen that can be cleaned and maintained automatically. The present invention provides such a pumping system.

SUMMARY

The present invention is a pumping system and method that reduces the amount of debris that may clog and even render inoperable a pump or other apparatus in a fluid pumping system.

The invention may be used in spa, hot tub, swimming pool, pond, aquarium, chemical treatment plant, or water treatment plant with a pumping system that includes, for example, a circulation pump and a high-speed pump. Circulation pumps are generally small, efficient pumps that are used for constant fluid circulation, while high-speed pumps are powerful pumps that are turned on periodically to operate, for example, water jets in a pool or spa. According to an embodiment of the invention, a high-speed pump may be turned on periodically to remove debris trapped in the screen, thereby automatically cleaning the screen.

For convenience, the remainder of this description will refer to a "water" pumping system in a spa. But it will be understood that the present invention is not limited to spa pumping systems, but rather may be used in any suitable fluid pumping system, including swimming pools, ponds, aquariums, chemical plants, or water treatment plants, in which fluid is circulated by a fluid pumping system. In addition, the description refers to a "screen" or "screening" apparatus and method. It will be appreciated by those skilled in the art that the terms "screen" and "screening" are not intended to limit the invention in any way, but rather are broad terms intended to encompass any apparatus or device that can be used to separate, sift, block, or trap any debris or particulate matter carried by the water passing through the pumping system, including without limitation screens, sieves, filters, strainers, and sifters. Moreover, as embodied in this invention, the "screen" may operate passively or actively, or using a combination of both. An example of a passive "screen" would be a sifting grid located within a pipe. An example of an active "screen" would be a motorized filtration system.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 1 is a perspective view of a spa with a cutaway section showing parts of a pumping system in accordance with an embodiment of the present invention.

FIG. 2 is a plan view of a pumping system in accordance with an embodiment of the present invention for use in a spa.

Like reference symbols in the various drawings indicate like elements.

DETAILED DESCRIPTION

Figure 3A:
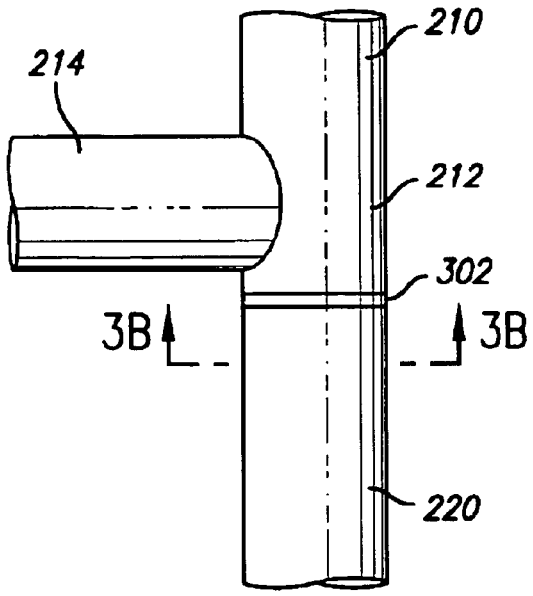
FIG. 3A shows an embodiment of the screen in accordance with an embodiment of the present invention.

In the following description, for purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid obscuring the present invention.

FIG. 1 shows a spa 100, including a cut-away section that reveals part of a water pumping system 101 used in the spa 100. The spa includes a vessel 101, in this case, a tub, for holding water. Those skilled in the art will appreciate that the tub is only an example of a vessel in accordance with the present invention. The various applications in which this invention may be used (e.g., swimming pools, aquariums, ponds) may have a different vessel, at least in shape and dimensions.

In accordance with an embodiment of the present invention, the pumping system 101 of the spa 100 includes a circulation pump 102, a jet pump 106, and a screen 116. Examples of suitable circulation pumps 102 include 98-Watt Circulation Pump manufactured by Laing Thermotech, Inc., as well as circulation pumps made by Grundfos, 3131 N. Business Park Ave., Freeno, Calif. 93727, or by Cal Pump, 13278 Ralston Ave., Sylmar, Calif. 91342. Examples of suitable jet pumps are the 3.0 or 4.0 HP 2-speed Sta-Rite pump, or single-speed pumps commonly used to filter pools or pump wells. The circulation pump 102 may be connected by a pipe 110 to circulation outlets 114 within the spa 100, and the jet pump 106 may be connected by a pipe 112 to jets 104 within the spa 100. A filtration inlet pipe 108 may be used to feed water from within the spa 100 to the input of the screen 116, and a pipe 118 may be used to connect the input of the jet pump 106 to the screen 116 and the inlet pipe 108 at or near the input to the screen 116. The output of the screen 116 may also be connected to the input of the circulation pump 102 by another pipe 120. The arrows in FIG. 1 indicate the direction of flow of water through the pumping system 101.

As explained above, the circulation pump 102 is a relatively small, efficient pump for continuously circulating the spa water using the circulation outlets 114. A separate jet pump 106, which is relatively large and high-powered in comparison to the circulation pump 102, is periodically used to pump water to the jets 104. Such a two-pump system may be more efficient than using a single pump for both circulating water and providing water at high pressure to the jets 104. This potential increase in efficiency results because the efficient low-power circulation pump 102 may be kept running at all times to keep the spa clean, while the high-power jet pump 106, which generally requires substantially more power than the circulation pump 102, need only be turned on periodically when operation of the jets 104 is desired.

The screen 116 in the embodiment of FIG. 1 may be used to trap or filter debris being carried in the water passing through the inlet pipe 108. Those skilled in the art will appreciate that spas generally include a skimmer and/or filter (not shown in FIG. 1) located between the inlet pipe 108 and the water in the spa 100. Such a skimmer/filter is used to trap debris in the water of the spa 100 so that debris will not reach the spa's pumps. However, in conventional pumping systems, some debris is able to bypass the initial skimmer/filter. Debris that bypasses the skimmer/filter may build-up on the impeller of the circulation pump 102, clogging the circulation pump 102 and even rendering it inoperable. Build-up of debris on the circulation pump 102 means that the pump 102 must be cleaned, which was done manually in conventional systems. Thus, in accordance with an embodiment of the present invention, the screen 116 is placed in the pumping system before the input to the circulation pump 102 to reduce the amount of water-borne debris that would otherwise reach the circulation pump 102. The jet pump 106 may then be operated periodically or as necessary to pull debris out of the screen 116 and divert the debris to the primary filters (not shown) of the spa 100. In addition, the powerful jet pump 106 may pump the debris back into the spa 100, where it may be trapped by the skimmer/filter.

FIG. 2 shows an exemplary spa pumping system 200 in accordance with an embodiment of the present invention. Those skilled in the art will appreciate, however, that the invention is not limited to spas; rather, the spa embodiment of the invention is merely shown as an example, and the invention can be applied to any filtered body of fluid, e.g., water. FIG. 2 shows a portion of a spa 204 having a surface 205 for holding water, with the water line being indicated by reference numeral 202. The spa 204 is shown separately in the upper left and lower right portions of FIG. 2, but those skilled in the art will recognize that both portions are part of the same spa 204. While not required, the pumping system 200 may include a skimmer 206 and a preliminary filter 208. As indicated by the arrows in the skimmer 206 and preliminary filter 208, water from the spa 204 passes through the skimmer 206 and the preliminary filter 208, both of which are designed trap at least some of the debris present in the water so that the debris will not reach the downstream parts of the pumping system 200. The downstream parts may include a screen, 222, a circulation pump 226 connected by pipe 228 to a heater 230, and an ozone generator 232 connected by a pipe 234 to an ozone injector 238, which is also connected to the heater 230 by a pipe 236. The optional ozone generator 232 and heater 230 may be coupled to the ozone injector 238, which outputs heated, ozonated water into the spa 204 via an output pipe 240 (see also reference numeral 242).

Some debris may escape the optional skimmer 206 and preliminary filter 208 and be carried in the water through pipes 210, 220, and 224 to a circulation pump 226. Accordingly, screen 222 is provided in the pumping system 200 to trap at least some of the debris that escapes the skimmer 206 and filter 208 before the debris can reach the input to the circulation pump 226 or any downstream features in the pumping system 200, such as the heater 230 or ozone injector 238. A jet pump 216, which may be connected by pipe 214 to pipes 210 and 220 using a T-junction 212 or other suitable plumbing device, may be run periodically or as needed to pull trapped debris from the screen 222 and divert the debris to the primary filters of the spa 204; for example, the jet pump 216 may pump the debris back into the spa water 202, where it may be trapped by the skimmer 206 and filter 208. As such, the screen 222 may be automatically cleaned, obviating the need for cumbersome, time consuming, expensive manual cleaning of the screen 222.

In the embodiment of FIG. 2, the jet pump 216 is coupled to the screen 222 via pipes 220 and 214 and junction 212. It will be appreciated, however, that the jet pump 216 and its coupling to the screen 222 could be configured differently. For example, pipe 214 could be eliminated. Alternatively, pipes 220 and 214 as well as junction 212 could be eliminated, with the jet pump 216 thus directly connected to the screen 222.

Figure 3B:
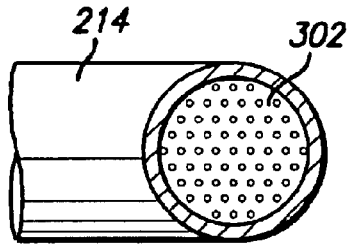
FIG. 3B is a cross-sectional view along line 3B—3B of FIG. 3A.
Figure 4A:
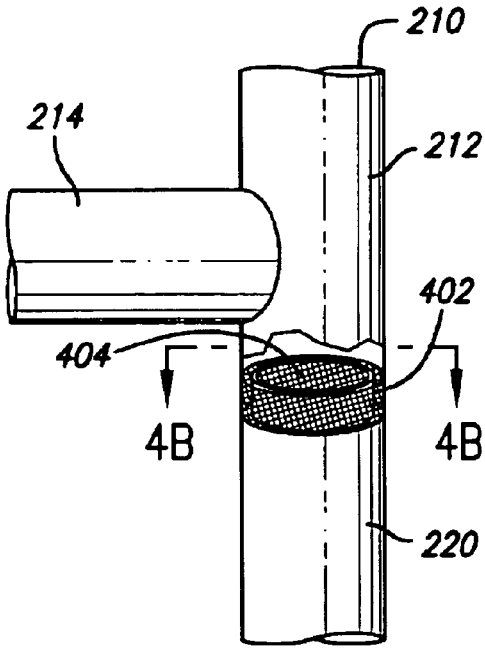
FIG. 4A shows an alternative embodiment of the screen in accordance with an embodiment of the present invention.
Figure 4B:
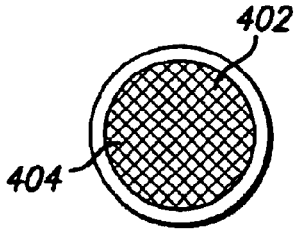
FIG. 4B is a cross-sectional view along line 4B—4B of FIG. 4A.

As those skilled in the art will appreciate, the screen 222 may be formed in a variety of ways. For example, as shown in FIGS. 3A and 3B, if the pipes 210 and 220 are cylindrical, a perforated, circular disk 302 may be inserted or integrally formed in pipe 220, so that the planar surface of the disk 302 is orthogonal to the flow of water. The perforated disk 302 has sufficient perforations to allow water to pass through the pipe 220 and to trap debris carried in the water. The number and dimension of the performations may be altered as necessary to permit sufficient water flow. Of course, if pipe 220 has a different cross-sectional shape, for example, a square shape, the disk 302 would have a corresponding shape. FIGS. 4A and 4B show an alternative embodiment of the screen 222, in which the screen 222 is formed from a flexible mesh 402 disposed over an opening 404 of pipe 220. In this alternative embodiment, pipe 220 is separate from, and inserted into, T-junction 212, allowing the flexible mesh 402 to be secured across the opening 404. FIG. 4B is a cross-sectional view along line 4B—4B in FIG. 4A, showing the flexible mesh 402 disposed over opening 404 in a manner that allows water to pass through the mesh 402 while at the same time trapping debris in the mesh 402.

A variety of methods may be used to effect operation of the jet pump 216 and thus automatic cleaning of the screen 222. One method is to provide a conventional timer 244, coupled to the jet pump 216. The timer 244 may be set up to turn the jet pump 216 on and off periodically, for example, once a day for five minutes, using, for example, a conventional switch or relay 245 on the jet pump 216. Such periodic running of the jet pump 216 allows the screen 222 to be cleaned automatically, as desired. The switch 245 could also be equipped with a manual feature, in addition to the timer 244, allowing the jet pump to be manually turned on and off to clean the screen 222, as needed, but without the need to manually remove the screen for cleaning. Alternatively, a conventional flow-sensing device 248 could be located before (or after) the circulation pump 226. The flow sensing device 248 could be coupled, for example, to a conventional controller 246 that, based on the flow rate of water in pipe 224 (or pipe 228), operates to turn the jet pump 216 on and off. As yet another alternative, a pressure sensing device, current or voltage sensing device, or other monitoring device could be provided in the pumping system 200 to monitor operation of the circulation pump 226, in known fashion. The pressure sensing device, current or voltage sensing device, or other monitoring device would then be coupled to the controller 246. As performance of the circulation pump 226 is impeded by the build-up of debris in the screen 222, the controller 246, monitoring such impeded performance, could operate to turn the jet pump 216 on and off, using, for example, the switch or relay 245. The controller 246 and sensor could be configured such that the controller turns on the jet pump 216 when the pressure, current, voltage, or other sensed parameter reaches, exceeds, or dips below a predetermined threshold level, in known fashion. Once the controller 246 determines that the sensed parameter has dropped back below or has gone back above the threshold level (for example, by a given amount), the controller could then operate to turn off the jet pump 216, in known fashion. Operating the jet pump 216 would then act to remove the trapped debris from the screen 222, allowing the circulation pump 226 to resume normal operation. It will be recognized from the above description that any time the powerful jet pump 216 is turned on and the circulation pump 226 is off, the jet pump 216 will pull water back through the jet pump 216 and thus clear the screen 222 of debris.

Those skilled in the art will recognize that other methods of automatically operating the jet pump 216 exist. For example, an optical sensor could be used to monitor the amount of debris trapped in the screen 222. All such alternatives fall within the scope and spirit of the present invention.

Accordingly, using the present invention, any debris that is trapped in the screen 222 may be automatically cleaned using the jet pump 216. This obviates the need for a human to manually clean the screen 222. It will be appreciated, however, that the invention is not limited to a single jet pump. Some pumping systems, for example, in a spa, may use multiple jet pumps. Any one or a combination of such jet pumps could be used to effect cleaning of the screen 222. Further, the invention is not limited to the use of a jet pump 216 to clean the screen 222. Any suitable pump may be used to clean the screen 222; for example, a high-powered pump used for draining the pool or spa could be operated periodically in order to automatically clean the screen 222. Moreover, the jet pump 216 may be replaced by any device capable of sucking or blowing debris from the screen 222.

In an alternative embodiment of the present invention, a dedicated high-power cleaning pump could be placed in line 210. A check valve is then installed in line 214. The dedicated pump in line 210 is then started when debris is to be removed from the screen 222. As another alternative, instead of using the jet pump 216, the circulation pump 226 may be run in reverse to clean the screen 222. In this alternative, the filter 208 could be removed, and the debris would flow back into the spa 204. The debris could then be removed from the spa water 202 manually or by replacing the filter 208.

A number of embodiments of the invention have been described. Nevertheless, it will be understood that various modifications may be made without departing from the spirit and scope of the invention. For example, the T-junction 212 shown in FIG. 2 need not be used; instead, pipes 210, 220, and 214 may be an integral T-pipe. Moreover, several alternative embodiments have been described for controlling operation of the jet pump 216 to remove debris from the screen 222. Any one, or a combination, of those embodiments may be used to control the jet pump 216. Accordingly, other embodiments are within the scope of the following claims.

What is claimed is:

1. A fluid pumping system comprising:

a first pump for circulating fluid, the first pump having an input for receiving fluid;

a screen coupled to the input of the first pump, the screen for filtering fluid before the fluid reaches the input of the first pump and preventing at least some debris present in the fluid from reaching the input of the first pump;

a second pump coupled to the screen for removing debris from the screen; and a control system for activating and deactivating the second pump, the second pump operating to remove debris from the screen when the second pump is activated;

wherein the control system includes a timer, coupled to the second pump, for periodically activating the second pump.

2. A fluid pumping system comprising:

a first pump for circulating fluid, the first pump having an input for receiving fluid;

a screen coupled to the input of the first pump, the screen for filtering fluid before the fluid reaches the input of the first pump and for preventing at least some debris present in the fluid from reaching the input of the first pump;

a second pump coupled to the screen for removing debris from the screen; and a control system for activating and deactivating the second pump, the second pump operating to remove debris from the screen when the second pump is activated;

wherein the control system includes a controller for monitoring pressure and for activating the second pump when the pressure reaches a predetermined threshold level.

3. The fluid pumping system of claim 2 wherein the controller is coupled to the first pump.

4. A fluid pumping system comprising:

a first pump for circulating fluid, the first pump having an input for receiving fluid;

a screen coupled to the input of the first pump, the screen for filtering fluid before the fluid reaches the input of the first pump and for preventing at least some debris present in the fluid from reaching the input of the first pump;

a second pump coupled to the screen for removing debris from the screen; and a control system for activating and deactivating the second pump, the second pump operating to remove debris from the screen when the second pump is activated;

wherein the control system includes a controller for monitoring a fluid flow rate and for activating the second pump when the fluid flow rate reaches a predetermined threshold level.

5. The fluid pumping system of claim 4 wherein the controller is coupled to the input of the first pump.

6. A fluid pumping system comprising:

a first pump for circulating fluid, the first pump having an input for receiving fluid;

a screen coupled to the input of the first pump, the screen for filtering fluid before the fluid reaches the input of the first pump and for preventing at least some debris present in the fluid from reaching the input of the first pump;

a second pump coupled to the screen for removing debris from the screen; and a control system for activating and deactivating the second pump, the second pump operating to remove debris from the screen when the second pump is activated;

wherein the control system includes a controller for monitoring at least one electrical parameter of the first pump and for activating the second pump when the electrical parameter reaches a predetermined threshold level.

7. A fluid pumping system comprising:

a first pump for circulating fluid, the first pump having an input for receiving fluid;

a screen coupled to the input of the first pump, the screen for filtering fluid before the fluid reaches the input of the first pump and for preventing at least some debris present in the fluid from reaching the input of the first pump; and a second pump coupled to the screen for removing debris from the screen;

wherein the first pump, the screen, and the second pump are part of a spa system that includes a vessel for holding water; wherein the first pump is a circulation pump for maintaining constant circulation of water in the vessel; and wherein the second pump is a jet pump for pumping water to at least one jet that emits the pumped water into the vessel.

8. The fluid pumping system of claim 7 wherein the screen is coupled by piping to a water inlet of the vessel; wherein the jet pump is coupled to the screen by a line.

9. A fluid pumping system, comprising:

a vessel for holding water, the vessel including at least one jet, at least one circulation outlet, and at least one filtration inlet; and a pumping system, including:

a circulation pump having an input and in output, the output of the circulation pump being coupled to the at least one circulation outlet, the circulation pump for circulating water in the vessel, a screen having an input and an output, the input of the screen being coupled to the at least one filtration inlet, the output of the screen being coupled to the input of the circulation pump, the screen for preventing debris carried in water from passing through the screen and reaching the input of the circulation pump, and a jet pump having an input and an output, the input of the jet pump being coupled to the filtration inlet and to the input of the screen, the output of the jet pump being coupled to the at least one jet, the jet pump for removing debris trapped in the screen and for pumping water to the at least one jet.

10. The fluid pumping system of claim 9, further comprising:

a filter for receiving at least some of the debris removed from the screen by operation of the jet pump and for filtering the received debris out of the water being circulated in the tub and the water being pumped to the at least one jet.

11. The fluid pumping system of claim 9, further comprising:

a heater coupled between the output of the circulation pump and the at least one circulation outlet; and the screen acting to prevent debris from reaching the heater.

12. The fluid pumping system of claim 11, further comprising:

an ozone system coupled between the output of the circulation pump and the at least one circulation outlet; and the screen acting to prevent debris from reaching the ozone system.

13. The fluid pumping system of claim 9, further comprising:

a control system for activating and deactivating the jet pump, the jet pump operating to remove debris from the screen when the jet pump is activated.

14. The fluid pumping system of claim 13 wherein the control system includes a timer, coupled to the jet pump, for periodically activating the jet pump.

15. The fluid pumping system of claim 13 wherein the control system includes a controller for monitoring pressure and for activating the jet pump when the pressure reaches a predetermined threshold level.

16. The fluid pumping system of claim 15 wherein the controller is coupled to the circulation pump.

17. The fluid pumping system of claim 13 wherein the control system includes a controller for monitoring a fluid flow rate and for activating the jet pump when the fluid flow rate reaches a predetermined threshold level.

18. The fluid pumping system of claim 17 wherein the controller is coupled to the input of the circulation pump.

19. The fluid pumping system of claim 13 wherein the control system includes a controller for monitoring at least one electrical parameter of the circulation pump and for activating the jet pump when the electrical parameter reaches a predetermined threshold level.

20. A fluid pumping system, comprising:

a vessel for holding water, the vessel including at least one jet, at least one circulation outlet, and at least one filtration inlet;

a pumping system, including:

a circulation pump having an input and an output, the output of the circulation pump being coupled to the at least one circulation outlet, the circulation pump for circulating water in the vessel, a screen having an input and an output, the input of the screen being coupled to at least one filtration inlet, the output of the screen being coupled to the input of the circulation pump, the screen for preventing debris carried in water from passing through the screen and reaching the input of the circulation pump, and a jet pump having an input and an output, the input of the jet pump being coupled to the filtration inlet and to the input of the screen, the output of the jet pump being coupled to the at least one jet, the jet pump for removing debris trapped in the screen and for pumping water to at least one jet; and a control system for activating and deactivating the jet pump, the jet pump operating to remove debris from the screen when the jet pump is activated.

21. The fluid pumping system of claim 20 wherein the control system includes a timer, coupled to the jet pump, for periodically activating the jet pump.

22. The fluid pumping system of claim 20 wherein the control system includes a controller for monitoring pressure and for activating the jet pump when the pressure reaches a predetermined threshold level.

23. The fluid pumping system of claim 22 wherein the controller is coupled to the circulation pump.

24. The fluid pumping system of claim 20 wherein the control system includes a controller for monitoring a fluid flow rate and for activating the jet pump when the fluid flow rate reaches a predetermined threshold level.

25. The fluid pumping system of claim 24 wherein the controller is coupled to the input of the circulation pump.

26. The fluid pumping system of claim 20 wherein the control system includes a controller for monitoring at least one electrical parameter of the circulation pump and for activating the jet pump when the electrical parameter reaches a predetermined threshold level.

27. A method for maintaining a fluid pumping system, comprising:

circulating fluid in the fluid pumping system via a pump having an input;

preventing at least some debris carried in the fluid from reaching the input of the pump via a screen; and automatically removing at least some debris from the screen by periodically activating a second pump via an electronic timer.

28. A method for maintaining a fluid pumping system, comprising:

circulating fluid in the fluid pumping system via a pump having an input;

preventing at least some debris carried in the fluid from reaching the input of the pump via a screen;

automatically removing at least some debris from the screen by activating a second pump via an electronic control system in response to a signal; and monitoring a parameter of the pumping system and generating the signal when the parameter reaches a threshold level.

29. The method of claim 28 wherein the parameter is one of voltage, current, fluid pressure, fluid flow rate, and light.

* * * * *